United States Patent [19]

Ghibely

[11] Patent Number: 4,807,793

[45] Date of Patent: Feb. 28, 1989

[54] ELECTRICALLY OPERATED DRIVING DEVICE

[76] Inventor: Bruno Ghibely, Vogelsand 87, 2070 Ahrensburg, Fed. Rep. of Germany

[21] Appl. No.: 75,665

[22] Filed: Jul. 20, 1987

[30] Foreign Application Priority Data

Aug. 2, 1986 [DE] Fed. Rep. of Germany ... 8620799[U]
Mar. 28, 1987 [DE] Fed. Rep. of Germany ... 8704666[U]

[51] Int. Cl.[4] ..... B25L 1/06
[52] U.S. Cl. ..... 227/131; 227/8
[58] Field of Search ..... 227/131, 8

[56] References Cited

U.S. PATENT DOCUMENTS 4,572,419 2/1986 Klaus et al. ..... 227/131 X

*Primary Examiner*—Paul A. Bell

*Attorney, Agent, or Firm*—Kinney & Lange

[57] ABSTRACT

Electrically operated driving device for staples, nails or the like, comprising an electric motor, a disc coupled to the electric motor, a cam means which cooperates with a driving pusher and with which the disc is movable into engagement to displace the driving pusher against a driving spring, and a trigger for actuation of the electric motor via an electrical switch including an actuating element, wherein between the switch and the trigger there is arranged a linkage which in the inactive state of the trigger is automatically aligned in the direction of actuation of the actuating element, and the disc and the shaft of the electric motor, respectively, has arranged thereon a projection such that it engages the linkage and moves it out of engagement with the actuating element when the driving pusher is released in its raised position.

9 Claims, 1 Drawing Sheet

ELECTRICALLY OPERATED DRIVING DEVICE

Figure 1:
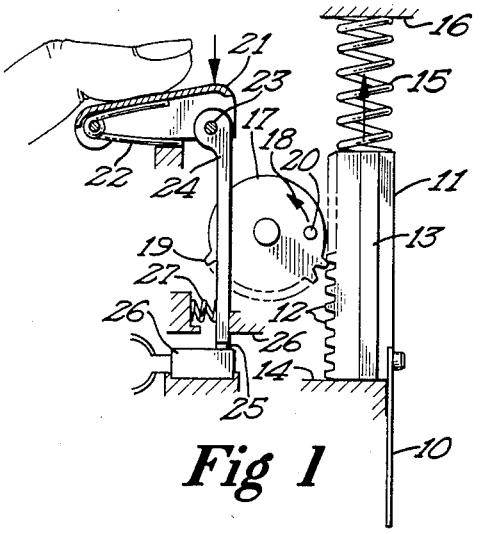

The invention relates to an electrically operated driving device for staples, nails or the like according to the preamble of claim 1.

There are prior electrically operated driving devices wherein the driving pusher is connected to an oscillating armature or a plunger-type armature. In the first case, the fastener is driven in by a plurality of driving hits. When a plunger-type armature is used, one hit or a small number of driving hits is sufficient to drive the fastener into the workpiece. The above-mentioned prior driving device employs an electric motor acting on a rack via a gear mechanism. A toothed segment of a gear is movable into engagement with a rack so as to move the rack opposite to a driving spring to a raised position. At the instant at which the last tooth of the toothed segment releases the rack, the latter is downwardly accelerated by the spring, thereby enabling the driving in of the fastener via the driving pusher (German Petty Pat. No. 1 684 420).

The known device, as all other usual driving devices, comprises a trigger through which the electric motor is activated. When the driving device, like in oscillating armature-type drives, is used as a sort of electric hammer, the driving pusher executes a plurality of hits on the fastener. The manual control of the device over the trigger therefore involves no problems. But if it is inteded to use the driving device for only a single driving hit, the operator is normally not in a position to release the trigger in time to prevent a further driving hit which would cause a further fastener advancing from the magazine into the ejecting passage to be driven in. Even if the operator prevented by timely release of the trigger that the rack and thus the pusher reach the upper dead-center position, this would cause unnecessary waste of energy which is disadvantageous in particular in case of battery supply.

The object of the invention therefore is to design an electrically operated driving device such that it is operable in an energy-saving manner and thus battery-operated.

According to the invention, said object is solved in that between the switch and the trigger is arranged a linkage which in the inactive state of the trigger is automatically aligned in the direction of operation of the operating element of the switch, and that a projection is arranged at the disc and the shaft, respectively, such that it engages on the linkage to move it out of engagement with the operating element as the driving pusher is released in its raised position.

Electrically operated driving devices include an electrical switch between the trigger and the electrically activated drive member, the electric motor here. Thus operation of the trigger causes closing of the switch. In the device according to the invention, the electrical switch is operated by the trigger via a special linkage. The linkage is, however, rendered ineffective by the projection connected to the shaft or disc as the pusher is released to perform a driving hit. Thus the electric motor remains energized only so long as required to move the pusher to the upper dead-center position. Any further energy supply, which might come from a battery, is prevented. Hence the driving device according to the invention is especially suited for battery operation.

The fact that in the driving device according to the invention the de-energization point of the electric motor depends on the position of the disc and the pusher, respectively, entails the further advantage that it is ensured that de-energization of the electric motor does not occur to early, either. A highly discharged battery possibly requires much more time to tension the driving spring. The arrangement according to the invention enables that also the longer time is waited and the electric motor is de-energized only upon execution of a driving hit. Thus the mechanical activation of the electrical switch provides for an optimum self-control at maximum care of the driving battery. Moreover, it is entirely independent of the respectively selected trigger mechanism.

The object of the invention can be solved also in that the driving pusher is coupled to the electrical switch through an adequate portion and a linkage to permit the switch to return to the de-energizing position as the pusher has reached the upper dead-center position. Such operation is, however, naturally more expensive and intricate than the aforedescribed one. Further, it is possible to provide two electrical switches in the housing of the driving device. One thereof is a trigger-operated activating switch serving only to activate the electric motor. The other thereof is a deactivating switch associated with the disc and the pusher, respectively, and operated by any of said components when the pusher is in the upper dead-center position. These embodiments too are more expensive and slightly more susceptible to failure.

There are several possibilities to move a driving pusher to the upper dead-center position against the force of a spring. In the above-described driving device, this is achieved in that the electric motor has coupled thereto a annular toothed segment cooperating with a rack which is part of the driving pusher and acts on the spring of the driving pusher, respectively. In such a case, the projection is expediently secured to the toothed segment and causes operation of the linkage as soon as it is out of engagement with the rack.

Another possibility of a drive consists, according to German Pat. No. 34 28 333, in that the driving pusher has connected thereto a U-shaped hook cooperating with a projection of an eccentric disc, the projection engages into the hook upon displacement of the pusher against the driving spring and remains out of engagement with the hook during the driving hit. In such drive, the linkage-operating projection is preferably moved into engagement with the linkage shortly after the driving projection has left the hook.

A third possibility of displacing a driving pusher to the upper dead-center position is to connect to the electric motor a respective cam plate or a plate comprising a cam track along which moves a cam or the like which in turn is operatively connected to the spring and the driving pusher, respectively. Displacement of the driving pusher to the upper dead-center position takes place during an almost complete rotation of the cam track. It has adjacent the radially farthest outwardly projecting portion a radially inwardly extending portion which enables the relaxation of the driving spring and the driving stroke of the driving pusher. In such drive, the projection moves the linkage preferably out of engagement with the operating element of the switch when the cam has reached the radial portion.

There are various constructional possibilities to arrange an adequate linkage between the trigger and the electrical switch. To this end, one embodiment of the invention provides that hinged to the trigger is an operating rod which is urged against an abutment by a spring such that the free end of the rod is aligned with the operating element of the switch and the projection of the gear moves the rod away from the abutment against the spring. This embodiment is applicable to all driving devices wherein the trigger is in the form of a switching lever or a push button.

The electric motor the driving plate and also the gear mechanism have a certain moment of inertia causing the driving disc to continue to rotate through a more or less great angle of rotation upon de-energization of the electric motor. When said angle of rotation has exceeded a specific value, in the case of e.g. a toothed segment the first teeth of the toothed segment get into engagement with the rack of the driving pusher, the driving pusher being in its lower dead-center position. The still inherent moment of the gear is not sufficient to raise the rack. Instead the gear rebounds, thereby rotating in the opposite direction. That rebound can be so strong that the linkage is thereby triggered again, thereby rendering the operation of the switch ineffective. In this case the gear must be rotated back by intervention from outside to undo the engagement with the linkage. That manipulation can perhaps be considered bothersome. An embodiment of the invention provides a remedy in that the electric motor shaft, the gear mechanism between the electric motor and the gear or the gear has associated therewith a back stop which prevents back-rotation of the gear opposite to the driving direction when the electric motor is activated. Back stops are known per se. They can be designed such that in every rotational position only the preferred direction of rotation is permitted. For the purposes of the driving device according to the invention it is, however, sufficient to provide a back stop only for a limited angle of rotation. As already described above, a back stop is to be effective only when the projection getting into engagement with the linkage has already released the linkage again. Such special reverse stop prevents that a rebound of the gear from the rack does not cause a re-operation of the linkage.

Various constructional possibilities are conceivable to provide such reverse stop. According to an embodiment of the invention, it consists in that an end face of the gear or an end face of the facing housing surface has formed therein a circular arc-shaped cam or the like whose forward end, as viewed in the direction of rotation, has a predetermined depth whereas the rear end terminates planely. Fixed to the housing or the gear is an axially resiliently supported pin which engages into the groove upon each revolution of the gear. Upon an undesired reverse rotation of the gear the projection moves against the deep end of the groove, thereby stopping the gear.

According to another embodiment, an end face of the gear or a housing portion facing the end face has arranged thereon a ramp-like portion cooperating with an abutment element which is arranged on the housing portion or the end face of the gear. Ramp-like portions or abutment elements are resiliently supported such that the abutment element moves up the ramp-like portion upon each revolution. Upon an undesired reverse rotation of the gear, the abutment element meets the high side of the ramp-like portion and stops the gear.

Finally, any rotating member of the electric motor, gear mechanism or gear can be provided with a co-rotating projection or cam which cooperates with a stop element resiliently arranged on the housing upon each revolution. In the working direction of rotation the projection or cam and stop element pass by each other almost without resistance.

In an opposite direction of rotation they function as abutments which offer insurmountable resistance to a reverse rotation of the gear. For example, the projection or cam can sweep a leaf spring which engages with its free end against the rotating projection upon rotation opposite to the working direction of rotation. Inversely the rotating member can be connected to a spring which sweeps a stationary cam in working direction of rotation, while causing a stoppage upon rotation in an opposite direction.

It is understood that the back stop is not confined to drives via toothed segments. It can also be employed in an eccentric disc of the above-described type which cooperates with a hook of the pusher.

Figure 2:
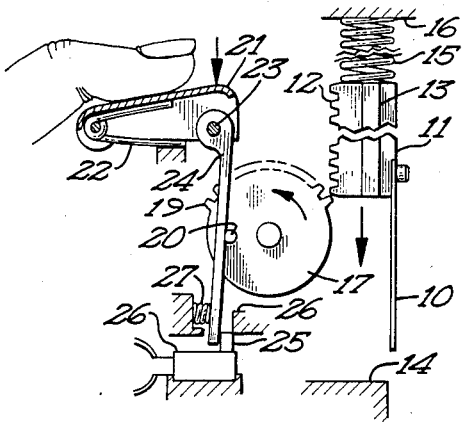
Figure 3:
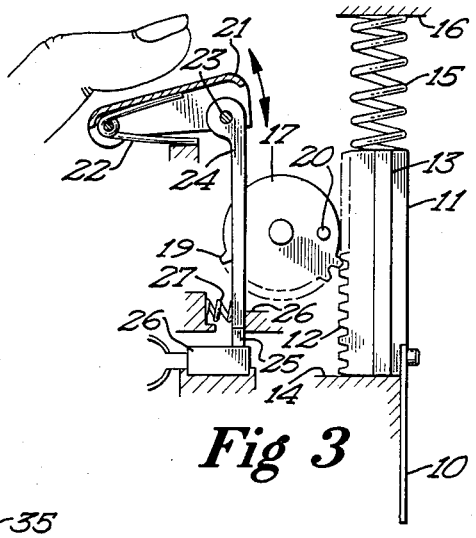
Figure 4:
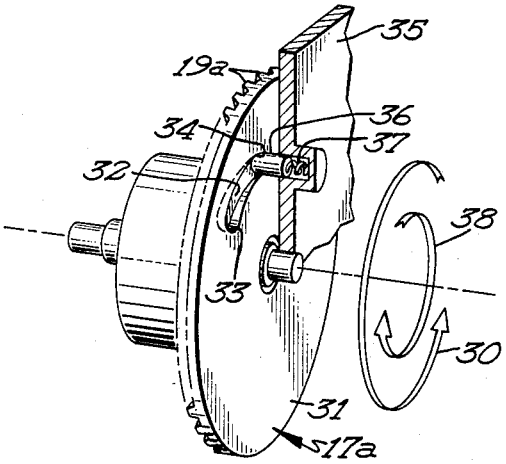
Figure 5:
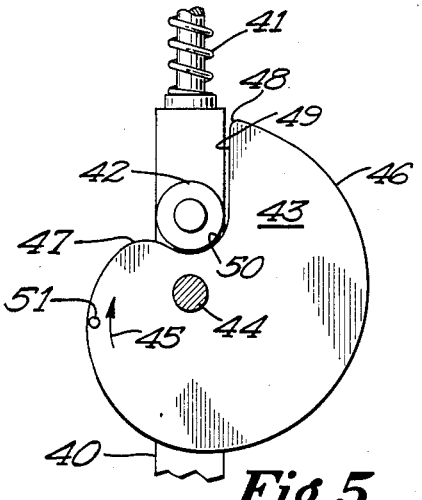

The invention will be described below with reference to the accompanying drawings in which FIG. 1 shows the condition upon operation of the trigger, FIG. 2 shows the condition shortly before execution of a driving hit, FIG. 3 the rest position, FIG. 4 is a perspective view of a gear with a back stop, FIG. 5 is a schematic view of another drive for a driving device.

A driving pusher 10 of an only very schematically illustrated battery-operated driving device is guided in a (not shown) driving passage of the device and connected to a rack 11 having a trapezoidal toothing 12. The rack has at least one guide rib 13 by which it is guided in an adequate guiding groove in the housing. It engages against an abutment 14 in the lower dead-center position. At the side opposite the driving pusher 10, the rack 11 is subjected to a driving spring 15 which engages with the other end against an abutment 16. The driving device comprises an electric motor which is connected directly or via a gear mechanism to a gear 17 which is driven in the direction of the arrow 18. The gear 17 includes a toothed segment 19 which extends over about 120° along the periphery of the gear 17. The trapezoidal toothing 19 coacts with the toothing 12 of the rack 11. A pin 20 is secured to an end face of the gear 17.

The driving device is operated by a trigger lever 21 which in a manner known per se is biased to the initial position by a spring 22. Hinged to the trigger lever 21 at 23 is a rod 24 whose free end is oriented in the positions shown in FIGS. 1 and 3 in the direction of an operating element 25 of an electrical switch 26. In this position the rod 24 rests laterally on an abutment 26. At the side opposite the abutment 26 is arranged a spring 27 which urges the rod 24 against the abutment 26.

The above-described driving device works as follows.

The actuating element 25 of the switch 26 is spring-loaded and in FIG. 3 is in the extended position in which the switch 26 is de-energized. The not shown electric motor is correspondingly de-energized. The rack 11 is in the lower dead-center position in which it abuts the abustment 14. The toothed segment 19 is shortly before its engagement with the rack 11. The operating rod 24 is aligned to the actuating element 25 of the switch 26. Upon operation of the device, the operator's thumb presses the trigger lever 21 downwardly as shown in FIG. 1, thereby engaging the actuating element 25 and activating the motor. The gear 17 commences to rotate in a counterclockwise direction, whereby the rack 11 is raised by the gear 17. The upper dead-center position is depicted in FIG. 2. At that instant in which the rack 11 has reached the upper dead-center position the pin 20 of the gear 17 is placed laterally against the rod 24 and pivots the latter against the spring 27 away from the abutment 26, so that the lower end slides off the actuating element 25. The operating element can therefore return to its initial position and de-energize the motor. Upon release of the trigger 21 it returns to the initial position. The operating rod 24 is raised and again placed against the abutment 26 through the spring 27 and thus aligned to the actuating element 25. At that instant in which the toothed segment 19 leaves the toothing 12 of the rack 11 the driving spring 15 urges the rack 11 and thus the driving pusher 10 downwardly, so that the driving pusher 10 can perform the driving hit.

FIG. 4 shows a gear similar to gear 17 of FIGS. 1 to 3 and denoted by reference numeral 17*a*. It is driven by a not shown electric motor via a (likewise not shown) gear mechanism, the working direction of rotation at the viewing side is counterclockwise according to arrow 30. The projection corresponding to projection 20 of FIGS. 1 to 3 is at the other invisible side of the gear 17*a*. It coacts in the same manner with a linkage and a trigger as described in the foregoing embodiment. As the illustration of FIG. 1 to 3 reveals, the gear 17 would meet the toothing of the rack and thus rebound, if, according to FIG. 3, it continued to move upon de-energization of the electric motor due to inertia. That rebound can be so strong that the projection 20 pivots the rod 24 once again, thereby rendering a triggering of the switch 20 ineffective. FIG. 4 shows a constructional example to prevent such operating condition.

In the visible end face 31 of the gear 17*a* is formed a circular arc-shaped groove 32. It has at one end at 33 a certain depth, whereas its other end terminates planely at 34. In a portion 35 of the housing of the not shown gear mechanism a pin 36 is axially movably supported and biased outwardly by a spring 37. Upon rotation of the gear 17*a* in the direction of the arrow 30, the pin 36 enters the groove 32 at each rotation at the end 33 and leaves the groove at 34.

When the gear 17 is rotated oppositely in clockwise direction, as indicated by arrow 38, the pin 36 also enters the groove 32, but meets the steep end wall at the end 33 and thereby prevents any further rotation of the gear 17*a*. The groove 32 and the pin 36 are now arranged such that a reverse rotation of the gear 17*a* takes place in a region in which the projection 20 of the FIGS. 1–3 embodiment is in the lower half, so that the projection 20 cannot engage the rod 24.

Instead of a groove 32 or the spring-loaded pin 36, the gear 17*a* or the housing portion 34 can have arranged thereon an elongated spring which is once swept by a rigid pin on the housing portion 35 or on the gear 17*a* upon each rotation as the gear 17*a* is rotated in the working direction of rotation 30. Upon an opposite rotation, the projection meets the free end of the spring, thereby stopping the gear 17*a*. Instead of a spring, it is also possible to use a unilaterally supported lever which in turn is resiliently supported.

FIG. 5 illustrates very schematically another drive mechanism for the driving pusher of a driving device. The driving pusher 40 is only outlined. Its upper end coacts with a helical spring 41 which upon displacement of the driving pusher 40 is biased to the upper dead-center position and has to provide the force for a driving hit. A roller 42 is rotatably mounted laterally on the pusher 40. The roller 42 cooperates with a cam plate 43 which is connected to a shaft 44. The shaft is connected to the not shown electric motor of the driving device. The plate 43 is rotated by the electric motor in clockwise direction, as indicated by the arrow 45. The cam 36 formed by the periphery of the cam plate 43 is spiral over most of its periphery. From point 47 on it increases gradually its radial distance from the axis of the shaft 44. The maximum distance is reached at 48. Adjacent to point 48 is a drastically radially inwardly extending portion 49 which terminates in a small indentation 50. The distance between the point 48 and the indentation 50 is slightly greater than the working stroke of the pusher 40, i.e. the roller 42 does not hit against the periphery of the cam plate 43 in the region of the indentation 50. Only upon further rotation of the plate 43 does the roller 42 get into engagement with the cam 46 again.

Also provided on the cam plate 43 is a projection 51. It resembles the projection 20 of the FIGS. 1–3 embodiment. The projection 51 actuates a linkage in a similar manner as described with the FIGS. 1–3 embodiment so as to render the operation of the activating switch for the electric motor.

In the embodiments described, the respective projections 20 and 51 are each connected to a driving disc. It is understood that it is a separate component connected to the shaft of the electric motor and coupled in its rotational position to the shaft such that the above-described effect on the switching linkage is attained.

I claim:

1. An electrically operated fastener driving device of the type having an electric motor, a disc coupled to the electric motor, a driving pusher, means which cooperate with the driving pusher and with which the disc is movable into engagement to displace the driving pusher against a driving spring, and a trigger having an active and inactive state for actuation of the electric motor via an electrical switch, the switch including an actuating element, the improvement which comprises an operating rod (24) pivotally connected to the trigger (21) and extending between the switch (26) and the trigger (21), in the inactive state of the trigger (21) the rod (24) being automatically aligned in the direction of actuation of the actuating element (25) and further comprising projection means (20,51) for engaging the rod (24) and moving it out of engagement with the actuating element (25) when the driving pusher (19,40) is released in its raised position.

2. Driving device as in claim 1, characterized in that the disc (43) includes a continuous cam surface (46) with which a cam follower (42) cooperates to displace the driving pusher (40) against the force of the driving spring (41), that the cam surface (46) includes a substantially radially extending portion (49) which is equal to or slightly greater than the stroke of the cam follower (42) at a driving hit of the driving pusher (40) from its upper dead-center position, and that the projection (51) is arranged such that it moves the rod (24) out of engagement with the actuating element when the cam follower (42) has reached the radial cam surface portion (49).

3. Driving device as in claim 1, characterized in that the operating rod (24) bears on an abutment (26) via a spring (27) such that the free end of the rod (24) is aligned with the actuating element (25) of the switch (26), with the projection moving the rod (24) away from the abutment (26) against the spring (27).

4. Driving device as in claim 1, characterized in that the projection means is formed by a pin at the end face of the disc (17).

5. Driving device as in claim 1, wherein the disc includes a toothed segment over part of its periphery and further comprising a rack cooperating with the toothed segment, characterized in that the projection means (20) is arranged such that it engages the linkage (24) and moves it out of engagement with the actuating element (25) when the toothed segment (19) releases the rack (12) in the raised position.

6. Driving device as in claim 5, characterized in that the shaft of the electric motor has associated therewith a back stop (32,36) which prevents backward rotation of the gear (17*a*) opposite to the driving direction of rotation (17*a*) when the electric motor is de-energized.

7. Driving device as in claim 6, characterized in that an end face (31) of the gear (17*a*) or a housing face facing the end face has formed therein a circular arc-shaped groove (32) or the like whose forward end (33) as viewed in the direction of rotation (30) has a predetermined depth, whereas the rear end (34) terminates planely, and that the housing (35) or the gear has arranged thereon an axially resiliently mounted abutment element (36), preferably a pin, which upon rotation of the gear (17) engages into the groove (32) per revolution, and that the groove (32) and the abutment element (36) are arranged such that coaction of the deepened end (33) of the groove (32) with the abutment element (36) prevents the projection (20) from getting into engagement with the linkage (20) upon backward rotation of the gear (17*a*).

8. Driving device as in claim 6, characterized in that a ramp-like portion is arranged at an end face of the gear or at a housing portion facing the end face, that an abutment element is arranged at the housing portion or at the end face of the gear, that the ramp-like portion or the abutment element is resiliently mounted, and that the ramp-like portion or the abutment element is arranged such that the abutment element sweeps the ramp-like portion upwards in the working direction of rotation of the gear, while abutting the raised end of the ramp-like portion upon an opposite rotation of the gear such that an engagement of the projection with the linkage is prevented.

9. Driving device as in claim 6, characterized in that a rotating member of the electric motor, gear mechanism or gear has arranged thereon a co-rotating projection or cam which cooperates with a resilient stop element arranged at the housing at each revolution such the the abutment element is passed by the projection or cam in the working direction of rotation of the gear, but stops the projection or cam upon an opposite rotation so that the projection does not get into engagement with the linkage upon a backward rotation of the gear.

* * * * *